United States Patent [19]

Mochimaru et al.

[11] Patent Number: 4,987,446

[45] Date of Patent: Jan. 22, 1991

[54] PROCESS UNIT CARTRIDGE FOR AN ELECTROPHOTOGRAPHIC APPARATUS

[75] Inventors: Hideaki Mochimaru; Kenya Komada; Masahiro Tomita; Rikio Kasahara, all of Yokohama, Japan

[73] Assignee: Ricoh Company, Ltd., Tokyo, Japan

[21] Appl. No.: 447,818

[22] Filed: Dec. 8, 1989

[30] Foreign Application Priority Data

Dec. 15, 1988 [JP] Japan ..... 63-316746
Feb. 9, 1989 [JP] Japan ..... 1-30521
Sep. 13, 1989 [JP] Japan ..... 1-238089

[51] Int. Cl.[5] ..... G03G 15/00
[52] U.S. Cl. ..... 355/200; 355/210
[58] Field of Search ..... 355/20.01, 210, 296, 355/260, 245; 222/DIG. 1

[56] References Cited

U.S. PATENT DOCUMENTS 4,563,076 1/1986 Takahashi et al. ..... 355/200
4,625,895 12/1986 Tsukano ..... 355/260 X
4,862,212 8/1989 Tanzawa et al. ..... 355/296 X
4,866,482 9/1989 Hirasawa et al. ..... 355/260
4,876,572 10/1989 Nagatsuna ..... 355/200 X
4,888,620 12/1989 Fujino et al. ..... 355/260 X

FOREIGN PATENT DOCUMENTS 0101303 2/1984 European Pat. Off. ..... 355/260
0314175 5/1989 European Pat. Off. ..... 355/296
0104971 6/1985 Japan ..... 355/260

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A cartridge for use in an electrophotographic apparatus is loaded with various expendable process units which need periodic replacement such as a charger, developing unit, and cleaning unit. At least the charger and cleaning unit are mounted on the cartridge integrally with each other. The cartridge is held in a body of the apparatus in such a manner as to be rotatable between a replaceable position and a set position.

7 Claims, 18 Drawing Sheets

PROCESS UNIT CARTRIDGE FOR AN ELECTROPHOTOGRAPHIC APPARATUS

BACKGROUND OF THE INVENTION

The present invention generally relates to an apparatus for recording an image on a paper sheet or similar recording medium by using an electrophotographic procedure and, more particularly, to a cartridge loaded with various process units which need periodic replacement, e.g., a charger, developing unit and cleaning unit and removably installed in the body of an electrophotographic apparatus.

An electrophotographic copier, facsimile machine, laser printer or similar apparatus implemented by an electrophotographic process is extensively used. This kind of apparatus includes an image carrier in the form of a photoconductive element. Arranged around the photoconductive element are process units such as a charger, writing unit, developing unit, image transferring unit, and cleaning unit. After the charger has uniformly charged the surface of the photoconductive element to a predetermined polarity, the writing unit writes a desired image in the photoconductive element. Then, the developing unit develops the image on the photoconductive element to produce a visible image. The visible image is transferred by the transferring unit to a paper sheet. The cleaning unit cleans the surface of the photoconductive element after such image transfer. Subsequently, the charger again charges the surface of the photoconductive element to prepare it for another photographic cycle.

A problem with the prior art apparatus of the type described is that the individual process units and parts thereof cannot be replaced, repaired or cleaned unless they are attached and detached one by one each time. When the photoconductive element, among others, is to be replaced, the various process units arranged therearound have to be removed one by one and, after the replacement, mounted again one by one. Moreover, in the event when the process units, especially the developing unit, are mounted and dismounted or when the photoconductive element is replaced, a developer is apt to be scattered around from the developing unit or the photoconductive element. In light of this, it has been proposed to mount the process units which are expendable supplies in a single casing or cartridge, as disclosed in Japanese Patent Laid-Open Publication (Kokai) Nos. 62-165670 and 61-118770 by way of example. Specifically, this prior art scheme mounts a photoconductive drum on the body of an electrophotographic copier or similar apparatus while mounting the charger, developing unit, cleaning unit and other process units on a single cartridge. The cartridge is replaced when the developing unit runs out of toner or when the charger or the cleaning unit fails.

An electrophotographic apparatus may be implemented by a developing unit including a developing sleeve and an agitator, and a developer container loaded with a toner or similar developer and removably mounted on the developing unit, as also proposed in the past. This prior art implementation, however, has a problem that at the time of replacement of the developer container the toner is apt to fall through a toner supply opening of the container to contaminate the interior of the apparatus.

SUMMARY OF THE INVENTION

It is therefore an object of the present invention to provide a process unit cartridge for use in an electrophotographic apparatus which frees one from troublesome manipulations otherwise needed to attach and detach various process units one by one.

It is another object of the present invention to provide a process unit cartridge for use in an electrophotographic apparatus which prevents a developer from being scattered around in the event of attachment and detachment of process units and the replacement of a photoconductive element.

It is another object of the present invention to provide a generally improved process unit cartridge for an electrophotographic apparatus.

In accordance with the present invention, in a cartridge for accommodating process units of an electrophotographic apparatus having a photoconductive element, a charger for charging the surface of the photoconductive element, a writing unit for writing an image on the charged surface of the photoconductive element to form an electrostatic latent image, a developing unit for developing the latent image to form a visible image, an image transferring unit for transferring the visible image to a paper sheet, and a cleaning unit for cleaning the surface of the photoconductive element after the image transfer, the charger again charging the cleaned surface of the photoconductive element, at least the charger and cleaning unit are mounted on the cartridge integrally with each other. The cartridge is held in a body of the apparatus in such a manner as to be rotatable between a replaceable position and a set position about a fulcrum provided at a side of the cartridge where the cleaning unit is positioned.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
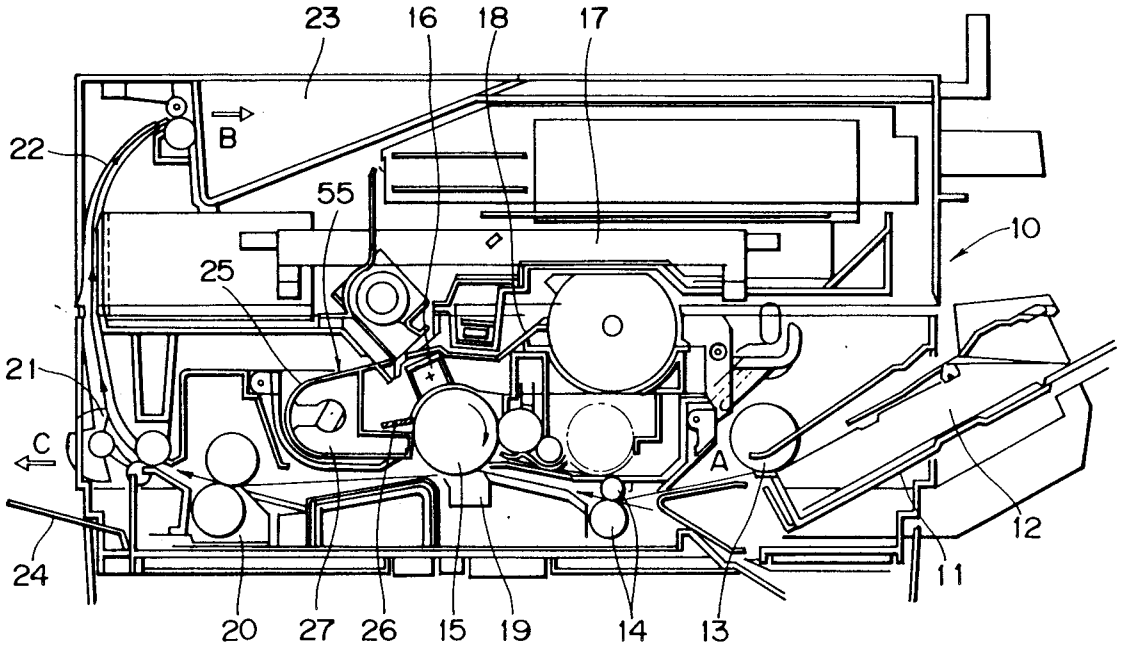
FIG. 1 is an elevation showing a laser printer implemented by a process unit cartridge embodying the present invention.

Referring to FIG. 1 of the drawings, a laser printer belonging to a family of electrophotographic apparatuses is shown in which a process unit cartridge embodying the present invention is installed. As shown, the apparatus has a body 10 and a paper cassette 11 which is removably mounted on the body 10 and loaded with a stack of paper sheets 12. A paper sheet 12 fed from the paper cassette 11 by a feed roller 13 as indicated by an arrow A is guided by a guide plate or similar member until it abuts against a pair of register rollers 14. After a temporary halt, the paper sheet 12 is again driven by the register rollers 14 at a predetermined timing toward an image carrier which is implemented as a photoconductive drum 15.

The drum 15 is rotated by a drive mechanism, not shown, in a clockwise direction as viewed in the figure. A charger 16 uniformly charges the surface of the drum 15 being rotated, and then a writing unit 17 scans the surface of the drum 15 by a laser beam for thereby electrostatically forming a latent image thereon. A developing unit 18 develops the latent image to produce a visible image on the drum 15. A transferring unit 19 transfers the visible image from the drum 15 to the paper sheet 12 which has been driven toward the drum 15 as stated previously. A fixing unit 20 heats and presses the paper sheet 12 carrying the visible image thereon so as to fix the visible image. Then, a switching device 21 selects a transport path 22 for discharging the paper sheet 12 with the fixed image to a face-down discharging section 23, as indicated by an arrow B. Alternatively, the switching device 21 may be so positioned as to direct the paper sheet 12 straight to a face-up discharging section 24. A cleaning unit 25 has a cleaning blade 26 which cleans the drum 15 to remove the developer which remains thereon after the image transfer. The removed developer is collected in a tank 27.

Figure 2:
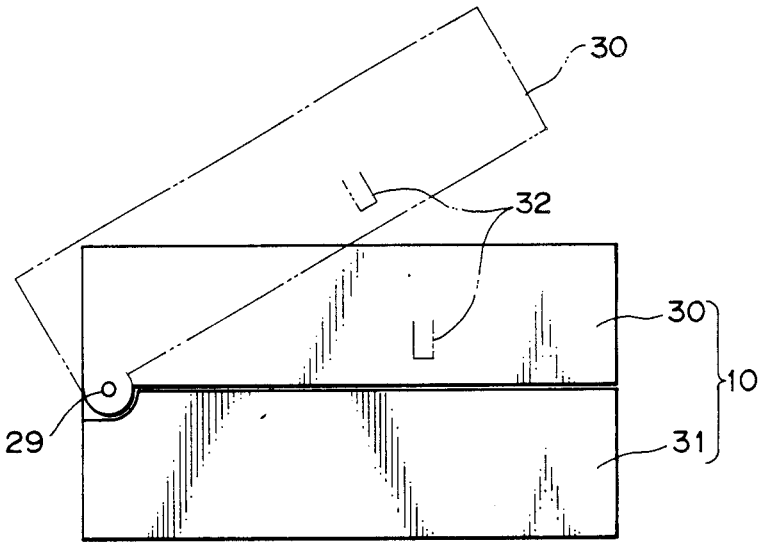
FIG. 2 is a schematic view illustrating that the laser printer of FIG. 1 has an upper body part which is rotatable relative to a lower body part.

As shown in FIG. 2, the printer body 10 is made up of an upper part 30 and a lower part 31. The upper body part 30 is movable or openable about a shaft 29 away from the lower body part 31. The upper body part 30 has a lug 32 which extends downward from a member accommodated in the upper part 30.

Figure 3:
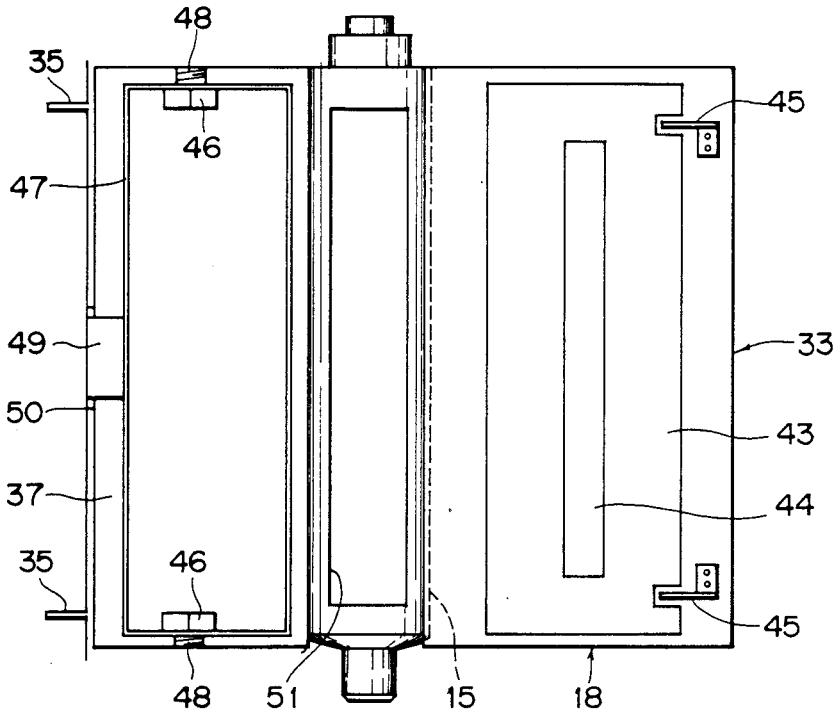
FIG. 3 is a plan view of an image forming case accommodated in a body of the laser printer.
Figure 4:
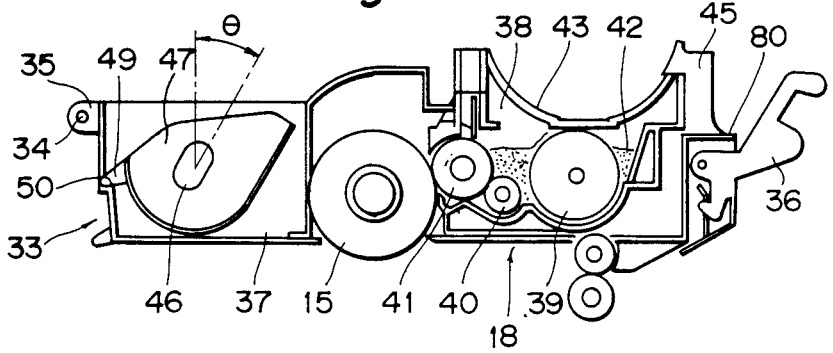
FIG. 4 is a section of the image forming case shown in FIG. 3.

Referring to FIGS. 3 and 4, an image forming case 33 incorporated in the lower body part 31 is shown. The image forming case 33 has a pair of lugs 35 at one side thereof and a locking lever 36 at the other side. Each lug 35 is formed with an opening 34 for receiving a shaft, while the locking lever 36 is constantly biased clockwise as viewed in FIG. 4. After the image forming case 33 has been rotatably positioned in the lower body part 31 by the shaft which has been received in the openings of the lugs 35, the locking lever 36 is engaged with a member provided in the lower body part 31 to thereby fix the case 33 in place. As shown in FIGS. 3 and 4, the drum 15 is positioned at the center of the image forming case 33. The developing unit 18 (see FIG. 1) is positioned at the right-hand side of the case 33 with respect to the drum 15, while a top-open bore 37 having a generally rectangular parallelepiped configuration is defined at the left-hand side of the case 33. The developing unit 18 has a developing chamber 38 thereinside, as well known in the art. An agitator 39, a supply roller 40 and a developing roller 41 are disposed in the developing chamber 38 in order to supply a developer 42 from the chamber 38 to the drum 15. The upper portion of the developing chamber 38 is delimited by a semicylindrical wall 43. An elongate opening 44 is formed through the semicylindrical wall 43 to communicate the developing chamber 38 to the outside. A pair of unlocking members 45 are affixed to the top of the image forming case 33 while protruding into the semicircular recess which is defined by the wall 43. Guide members 46 are located face to face in the top-open bore 37, and each is supported by a shaft. A single bucket 47 is also disposed in the bore 37 and rotatably supported on the same shafts as the guide members 46. Coil springs 48 are individually wound round the shafts to bias the bucket 47 counterclockwise as viewed in FIG. 4. A lug 49 extending out from the bucket 47 abuts against a shoulder 50 of the image forming case 33, whereby the counterclockwise movement of the bucket 47 is restricted. As shown in FIG. 4, the bucket 47 is held in a position tilted by the same angle $\theta$ as the guide members 46 to the vertical. In FIG. 3, the reference numeral 51 designates an elongate rectangular opening formed through the image forming case 33 above the drum 15.

Figure 5:
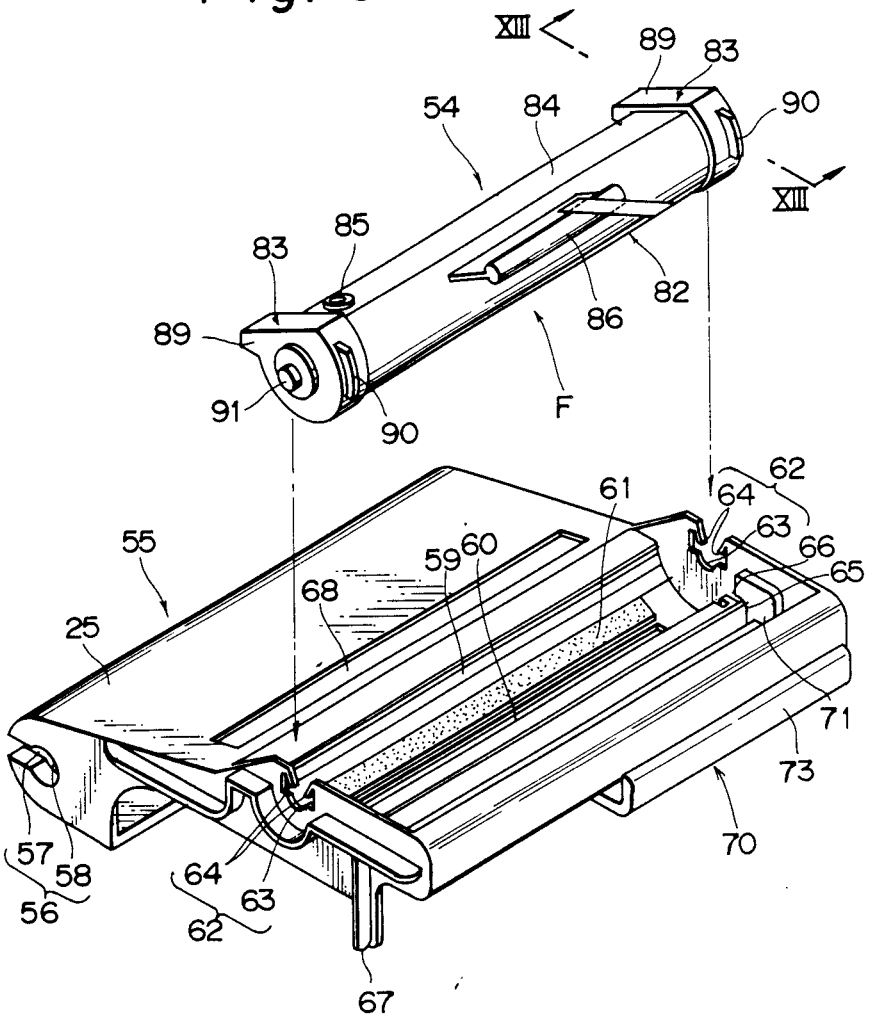
FIG. 5 is a perspective view showing how a developer container is mounted on the cartridge.

Referring to FIG. 5, a process unit cartridge embodying the present invention is shown and generally designated by the reference numeral 55. The cartridge 55 is mounted on the image forming case 33, as follows. As shown, a developer container 54 is mounted on the right-hand side of the cartridge 55, while the cleaning unit 25 (see FIG. 1) is provided on the left-hand side. A recess 56 is formed in each of opposite walls of the cleaning unit 25. Each recess 56 has a straight channel portion 57 and a circular portion 58 contiguous with the straight portion 57. The cartridge 55 has a semicylindrical wall section 59 for receiving the developer container 54. An opening 60 is formed through the wall section 59 for supplying the developer, as will be described. The opening 60 has the same dimensions as the previously mentioned opening 44 and is elongate as the opening 44. Seal members 61 are implemented by sponge and adhered to the wall section 59 at opposite sides of the opening 60. Container retaining sections 62 are positioned at opposite sides and outwardly of the wall section 59. Each container retaining section 62 has a semicircular top-open mating portion 63 and two elastic portions 64 extending obliquely downward toward the mating portion 63. At each side of the wall section 59, a cruciform hole 65 and a channel-like hole 66 are formed side by side.

Legs 67 extend downward from opposite ends of the right-hand side of the cartridge 55 as viewed in FIG. 5. When, the cartridge 55 is placed on a table, for example, the legs 67 will cooperate with the cleaning unit 25 to maintain the cartridge 55 in a stable position. Further, an opening 68 for writing an image is formed through the cartridge 55 and will align with the opening 51 of the image forming case 33 when the cartridge 55 is mounted on the case 33. Although not shown in FIG. 5, the charger 16 is affixed to the inner periphery of the cartridge 55 in parallel with the opening 68. When the cartridge 55 is mounted on the image forming case 33, the charger 16 will enter the case 33 via the opening 51 to face the drum 15, as shown in FIG. 1.

Figure 6:
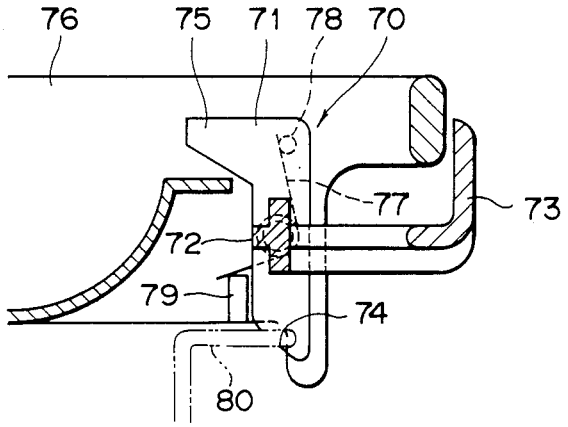
FIG. 6 is a fragmentary section of the cartridge, showing a locking lever included therein.

A locking lever 70 is rotatably mounted on the cartridge 55. As shown in FIG. 6, the locking lever 70 is made up of a pair of spaced lever portions 71, a shaft portion 72 interconnecting the lever portions 71, and a knob portion 73 extending out from the shaft portion 72. Each lever portion 71 has a notch 74 at the lower end and a lug 75 at the upper end. The locking lever 70 is supported at opposite ends thereof by a pair of frames 76 which form a part of the cartridge 55, the knob portion 73 protruding to the outside of the frames 76. A spring 77 is wound around each end of the shaft portion 72 which is supported by the associated frame 76. The spring 77 is anchored at one end to a stub 78 extending from the lever portion 71 and at the other end to a stop 79 extending from the frame 76. In this configuration, the locking lever 70 is constantly biased by the springs 77 clockwise as viewed in FIG. 6 and is stopped by the stops 79. FIG. 6 shows the cartridge 55 in a position mounted on the image forming case 33 and, in this position, the notches 74 are mated with an end 80 (see FIG. 4) of the case 33 with the lever portions 71 being spaced apart from the associated stops 79.

Figure 7:
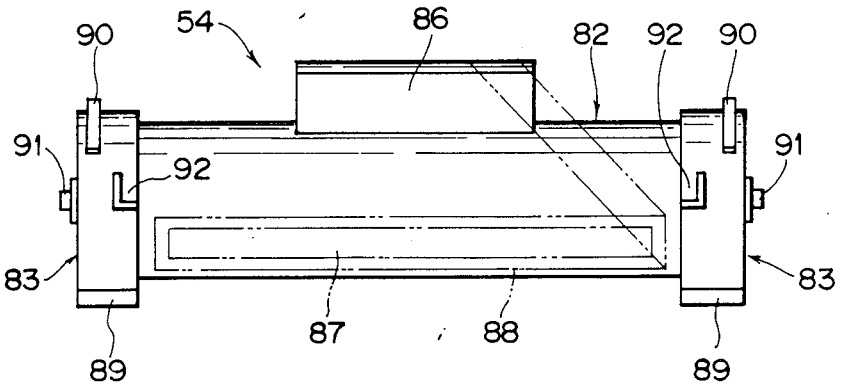
FIG. 7 is a view of the developer container as seen in a direction indicated by an arrow F in FIG. 5.

As shown in FIG. 5, the developer container 54 for supplying the developer 42 to the developing unit 18 has a cylindrical body portion 82, and caps 83 mounted on opposite ends of the body portion 82. The body portion 82 is cut in a plane parallel to the axis of thereof to form a flat surface 84 having a predetermined width. A hole is formed through the flat surface 84 adjacent to either end of the developer container 54 and is closed by a plug 85. A handle 86 extends radially outward from a part of the periphery of the body portion 82. As shown in FIG. 7, an elongate opening 87 is formed through and along the axis of the container 54 and is provided with the same dimensions as the previously stated openings 60 and 44. The opening 87 is closed by a seal 88 as indicated by a dash-and-dots line in FIG. 7. One end (right end as viewed in FIG. 7) of the seal 88 is somewhat extended and fitted on the handle 86. As shown in FIG. 5, each cap 83 has a radially extending lug 89, a circumferentially extending rail-like locking portion 90, and a stub 91 which aligns with the center of the body portion 82 when the cap 83 is affixed to the body portion 82. Further, as shown in FIG. 7, each cap 83 has a locking pawl 92 which is formed by cutting out the periphery of the cap 83 in the form of a letter L and then slightly raising it.

Figure 8:
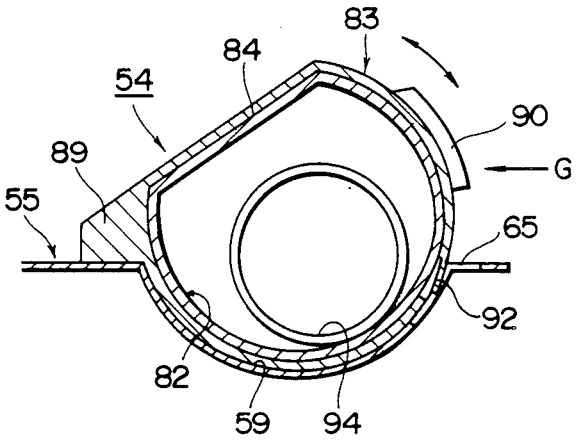
FIG. 8 is a section along line XIII—XIII of FIG. 5.
Figure 9:
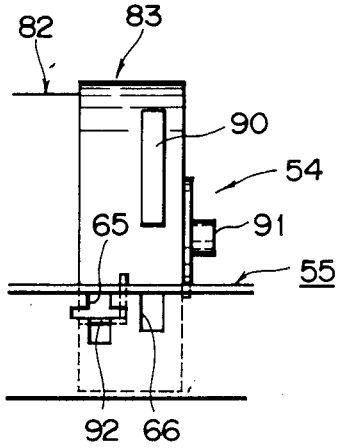
FIG. 9 is a side elevation as seen in a direction indicated by an arrow G in FIG. 5.

In assembly, as shown in FIG. 5, the developer conainer 54 is loaded on the semicylindrical wall section 59 of the cartridge 55 from above. Specifically, the stubs 91 of the container 54 are individually engaged with the mating sections 63 while forcing the elastic portions 64 open. After the passage of the stubs 91, the elastic portions 64 regain their original position to positively retain the stubs 91 in the container retaining portions 62. Then, the lugs 89 of the caps 83 are abutted against the upper surface of the cartridge 55. This causes the locking pawls 92 of the caps 83 to individually enter the cruciform holes 65 of the wall section 59 of the cartridge 55 until their tips abut against the edges of the laterally extending parts of the holes 65, as shown in FIGS. 8 and 9. In this condition, the developer container 54 is prevented from rotating on the wall section 59 in directions indicated by a double-headed arrow in FIG. 8. At the same time, the developer container 54 is positioned in such a manner as to close the opening 87. In FIG. 8, the reference numeral 94 designates a coil spring which is accommodated in the body portion 82 of the developer container 54 and caused to vibrate for the purpose of fully emptying the container 54.

Subsequently, the seal 88 fitted on the handle 86 is removed and then torn off. However, since the opening 87 of the developer container 54 is closed by the seal member 62 of the wall section 59, the developer 42 in the container 54 is prevented from leaking therethrough.

Figure 10:
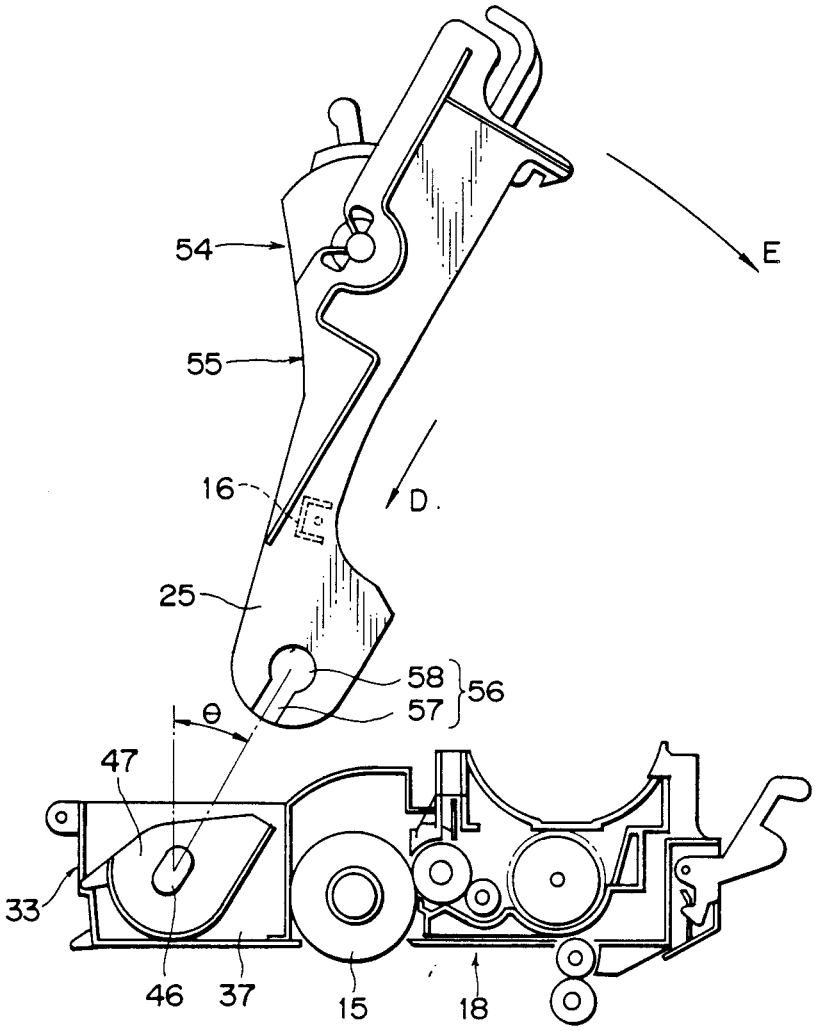
FIG. 10 is a view showing how the cartridge is mounted on the image forming case.
Figure 11:
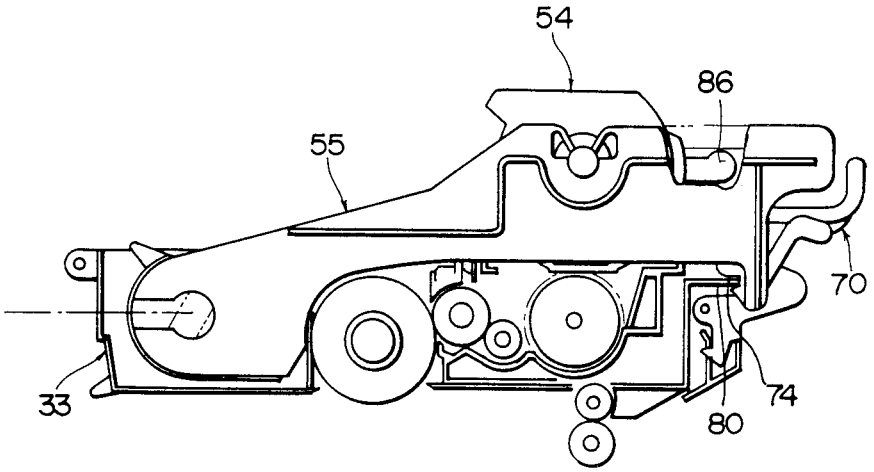
FIG. 11 is a view showing the cartridge having been brought to a set position from the position shown in FIG. 10 and the developer container having been brought to an open position.
Figure 12:
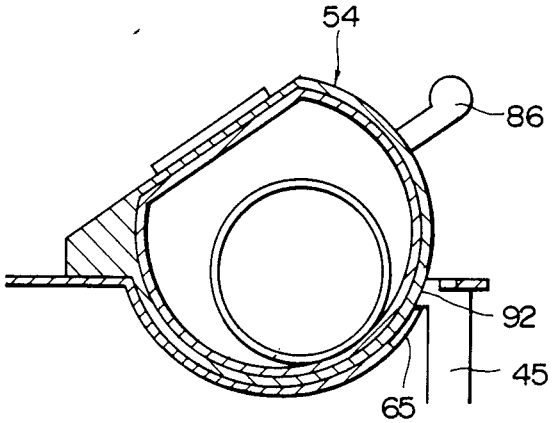
FIG. 12 is a section showing a locking pawl and a cruciform opening which are mated with each other after the developer container has been brought to a closed position.
Figure 13:
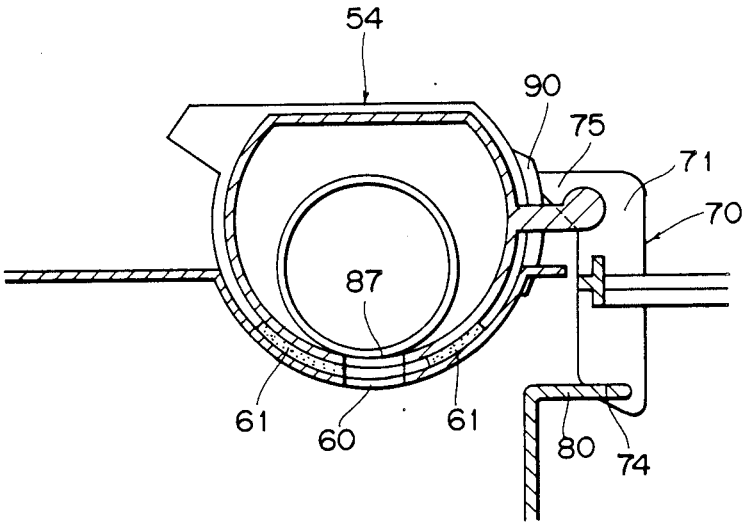
FIG. 13 is a section showing the cartridge which is held in the set position by a locking device after the developer container has been moved to the open position.

The cartridge 55 loaded with the developer container 54 as stated above is mounted on the printer body 10, as follows. As shown in FIG. 10, the cartridge 55 is inserted into the image forming case 33 in a direction indicated by an arrow D, while being inclined by the angle $\theta$ to the vertical with the cleaning unit 25 being lowest. As the cartridge 54 is inserted in the direction D, the straight portions 57 of the recesses 56 individually mate with the guide members 46. As the cartridge 54 is inserted deeper into the direction D, it is fully received in the bucket 47 with the guide members 46 entering the circular portions 58 of the recesses 56. In this condition, the cartridge 55 is held in a replaceable position and rotatable in a direction indicated by an arrow E. Then, the cartridge 55 is rotated together with the bucket 47 about the guide members 46 in the direction E and against the action of the springs 48, the resulting position being shown in FIG. 11. Subsequently, the notches 74 of the locking lever 70 are mated with the end 80 of the image forming case 33. As a result, the unlocking members 45 push the locking pawls 92 out of the cruciform holes 65, as shown in FIG. 12. The developer container 54 is now free to rotate. As the upper body part 30 is closed, the downwardly extending lug 32 (FIG. 2) presses the handle 86 downward to automatically rotate the developer container 54 from the closed position to the open position shown in FIG. 11. As shown in FIG. 13, in the open position of the developer container 54, the opening 87 is uncovered and aligned with the opening (FIG. 3) via the opening 60, whereby the developer 42 is fed from the container 54 to the developing chamber 38 (FIG. 4). On the other hand, the locking portions 90 of the container 54 enter the holes 66 of the cartridge 55 and face the lugs 75 of the lever portions 71 of the locking lever 70, as shown in FIG. 13. In this position, the locking portions 90 prevent the locking lever 70 from unlocking the developer container 54.

While the seal 88 has been described as being torn off while the developer container 54 is held in the closed position, it may be done so after the container 54 has been brought to the open position to align the openings 87 and 70, as shown in FIG. 13.

When the developer container 54 has run out of the developer 42, the cartridge 55 is replaced with a new cartridge by the following procedure. Specifically, after the upper body part 30 has been opened away from the lower body part 31, the handle 86 is raised to rotate the developer container 54 from the open position shown in FIG. 13 to the closed position shown in FIG. 12. As a result, the opening 87 of the developer container 54 is brought out of alignment with the opening 44. Then, the knob 73 is raised to rotate the locking lever 70 to release the notches 74 from the case end 80. In this condition, the cartridge 55 is bodily rotated about the guide members 46 from the set position to the replaceable position. This releases the locking pawls 92 from the unlocking members 45 and causes them to engage with the cruciform holes 65 again, thereby preventing the developer container 54 from rotating. Thereafter, the cartridge 55 is pulled out from the image forming case 33 in the direction opposite to the direction D shown in FIG. 10. A new cartridge 55 loaded with a full developer container 54 beforehand is mounted on the image forming case 33 by the previously stated procedure. Finally, the upper body part 30 is closed to automatically supply a developer 42 from the fresh container 54 into the developing chamber 38.

As stated above, in the illustrative embodiment, the cartridge 55 cannot be rotated to the replaceable position unless the developer container 54 is rotated to the closed position by the locking device. This is successful in preventing one from rotating the cartridge 55 with the opening 87 being kept open and, therefore, in preventing the developer 42 from being scattered around through the opening 87. Also, when the cartridge 55 is brought to the replaceable position, the locking device inhibits the developer container 54 from rotating to the open position and thereby eliminates the leakage of the developer 42 through the opening 87. Since the toner collecting opening of the cleaning unit 25 faces upward while the cartridge 55 is in the replaceable position, the used cartridge 55 is replaced without the developer 42 being scattered around.

Figure 14:
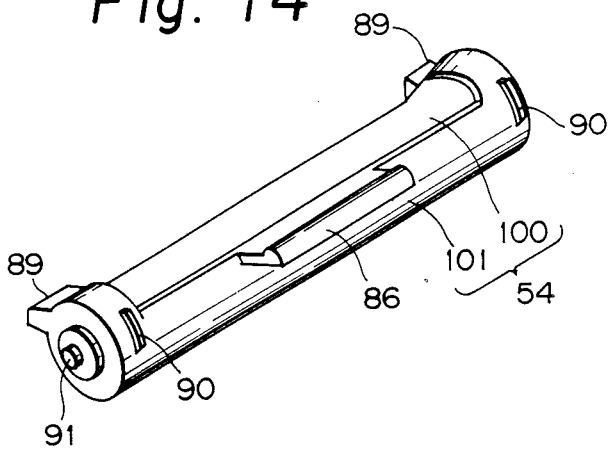
FIG. 14 is a perspective view showing an alternative configuration of the developer container.
Figure 15:
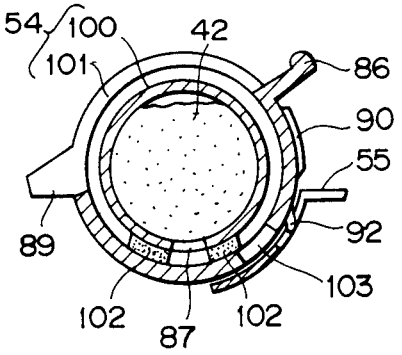
FIG. 15 is a section showing the developer container of FIG. 14 which is held in a closed position on the cartridge.

In the illustrative embodiment, the developer container shown in FIGS. 5 and 7 is mounted on the cartridge 55 and then bodily rotated between the closed and open positions. Alternatively, as shown in FIG. 14, the developer container 54 may be composed of a container body 100 and a cover 101 which is openable. As shown in FIG. 15, the elongate opening 87 is formed through the container body 100 and is surrounded by seal members 102 which are adhered to the container body 100. The developer 42 is filled in the container body 100. The cover 101 is rotatably mounted on the container body 100 while covering the entire circumference at opposite ends of the latter and one half of the circumference at the intermediate between the opposite ends. The cover 101 has the handle 86 extending radially outward from the intermediate portion, the lugs 89 extending radially outward from the opposite ends, and the rail-like locking portions 90 each extending along the circumference. Further, the cover 101 has the stubs 91 aligning with the axis of the container body 100 and pawls 92 and an axially extending elongate opening 103.

Figure 16:
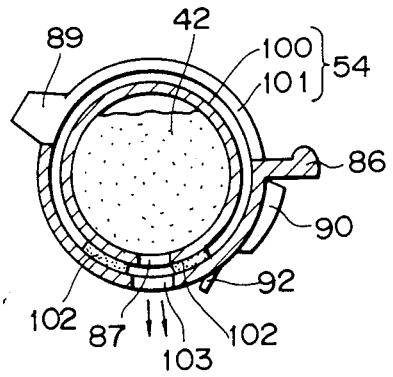
FIG. 16 is a section showing the developer container of FIG. 14 in an open position.

As in the previous embodiment, the developer container 54 is mounted on the wall section 59 of the cartridge 55 with the stubs 91 being retained by the container retaining portions 62. The lugs 89 of the developer container 54 are abutted against the upper surface of the cartridge 55. In this condition, the pawls 92 enter the individual cruciform holes 65 of the wall section 59 until their tips engage with the edges of the laterally extending parts of the holes 65. As a result, the cover 101 is prevented from rotated clockwise as viewed in the figure on the wall section 59. In this closed position of the cover 101, the opening 87 of the container body 100 is not aligned with the opening 103, as shown in FIG. 15. However, when the cartridge 55 is mounted on the image forming case 33, the unlocking members 45 press the pawls 92 to render only the cover 101 rotatable from the close position to the open position. When the cover 101 is rotated to the open position. When the cover 101 is rotated to the open position, the openings 87 and 103 are brought into alignment, as shown in FIG. 16.

Figure 17:
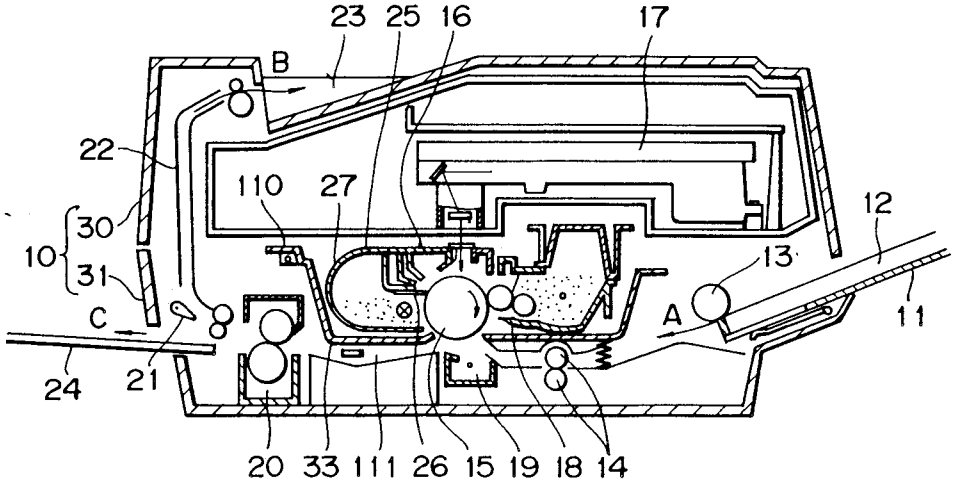
FIG. 17 is a view of a laser printer incorporating an alternative embodiment of the process unit cartridge in accordance with the present invention.
Figure 18:
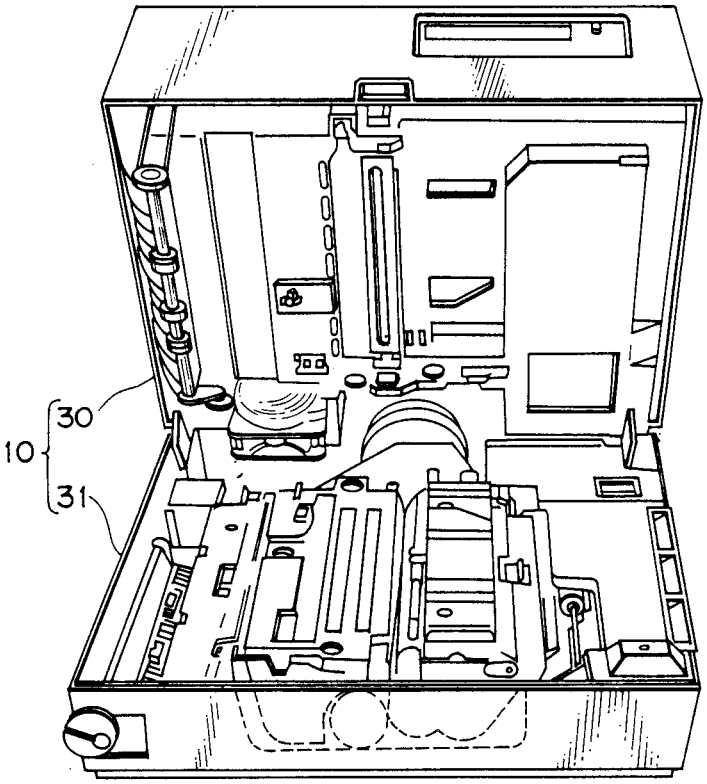
FIG. 18 is a perspective view of the laser printer of FIG. 17, showing an upper body part in an open position.
Figure 19:
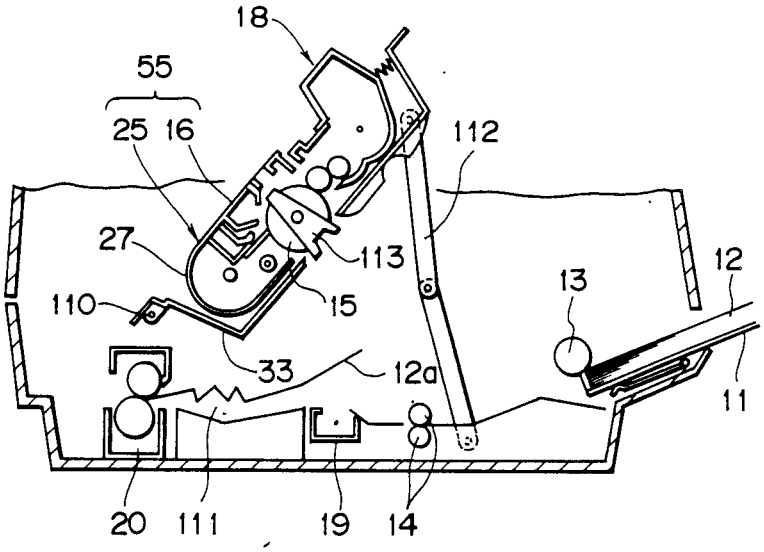
FIG. 19 is a view of a lower body part of the laser printer of FIG. 17, showing an image forming case in a rotated position.

Referring to FIG. 17, a laser printer incorporating an alternative embodiment of the process unit cartridge in accordance with the present invention is shown. In the figures, the same components and structural elements are designated by like reference numerals, and redundant description will be avoided for simplicity. As shown, the printer body 10 is also made up of the upper body part 30 and lower body part 31. Additionally, the image forming case 33 comprises an opening 110 similar to the opening 34 shown in FIG. 4. As shown in FIG. 18, the upper body part 30 is openable away from the lower body part 31. Specifically, assume that the paper sheet 12 has jammed the printer. Then, as shown in FIG. 19, the upper body part 30 is opened and the image forming case 33 is bodily rotated counterclockwise as viewed in the figure, whereby a paper transport path 111 defined below the case 33 is uncovered. Subsequently, a stand 112 interconnecting the image forming case 33 and lower body part 31 is extended to support the case 33 in the rotated position. This allows the jamming paper sheet, **12*a* in FIG. 19, to be removed with ease. The image forming case 33 is loaded with the photoconductive element 15 which is provided with a knob 113, as well as the charger, 16, developing unit 18, and cleaning unit 25**.

Figure 20:
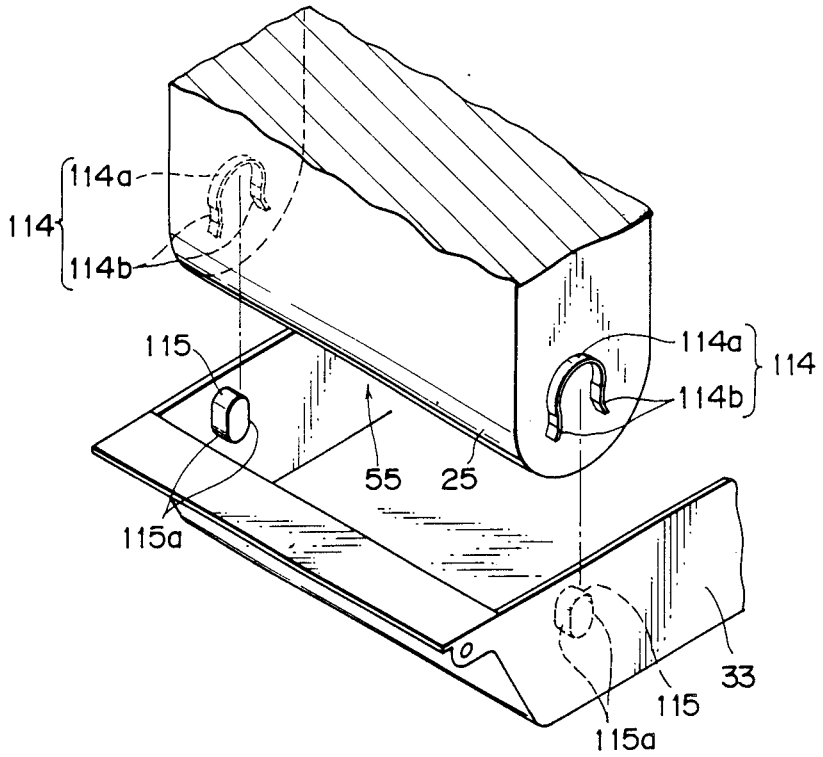
FIG. 20 is an exploded perspective view showing a part of the cartridge shown in FIG. 17 and a part of the image forming case.
Figure 21:
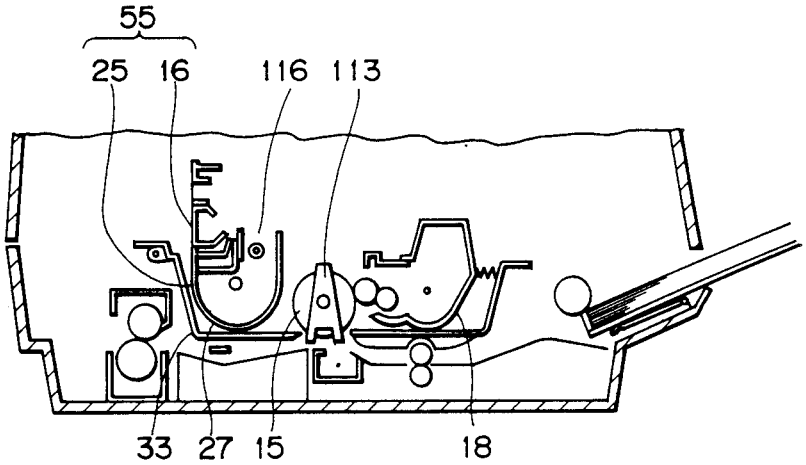
FIG. 21 is a view of the lower body part of FIG. 19, showing the cartridge in a replaceable position.
Figure 22:
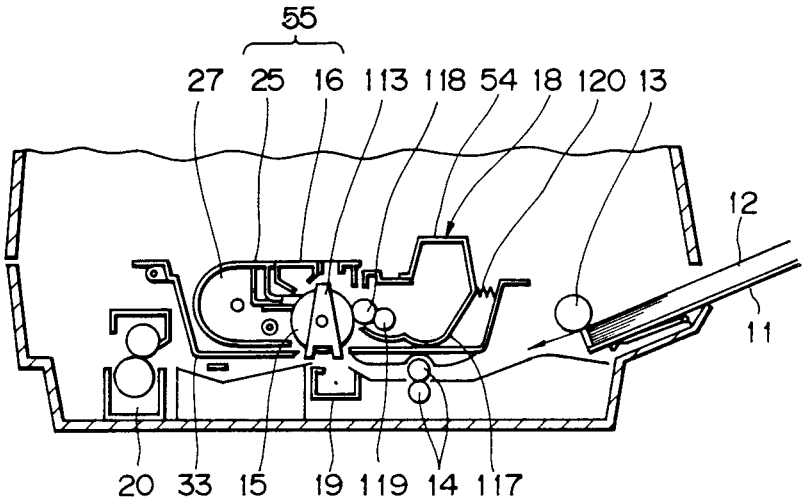
FIG. 22 is a view of the lower body part of FIG. 19, showing the cartridge in a set position.

In this particular embodiment, the cartridge 55 has the charger 16 and cleaning unit 25 formed integrally therewith. As shown in FIG. 20, the cartridge 55 is provided with bearing portions 114 at opposite sides of one end thereof which is adjacent to the cleaning unit 25. Each bearing portion 114 is composed of a ring portion 114*a* and spaced parallel portions 114*b* extending from opposite ends of the ring portion 114*a*. As also shown in FIG. 20, the image forming case 33 is provided with stubs 115 on facing inner surfaces thereof. Each stub 115 is cut vertically at opposite sides thereof to form flat surfaces 115*a*. As shown in FIG. 21, the cartridge 55 is mounted on the image forming case 33 by mating the bearing portions 114 with the stubs 115, i.e., by mating the ring portions 114*a* with the hubs 115 via the parallel portions 114*b*. In this condition, the cartridge 55 is held in the replaceable position with the collecting tank 27 having its opening 116 directed upward. The cartridge 55 in the replaceable position is ready to rotate about the stubs 115 to a set position which is shown in FIG. 22. As shown in FIG. 22, the developing unit 18 has a developing case 117 in which a developing roller 118 and a supply roller 119 are disposed. A spring 120 is preloaded between the image forming case 33 and the developing case 117. After the developer container 54 has been mounted on the developing case 117, the developing case 117 is urged toward the drum 15 by the spring 120 resulting in the developing roller 118 being urged against the developing roller 118.

The upper body part 30 is opened, as shown in FIG. 18. Then, the cartridge 55 is rotated from the set position shown in FIG. 22 to the replaceable position shown in FIG. 21. As a result, the cleaning unit 25 is spaced apart from the drum 15 while the charger 16 and the like are also moved away from the drum 15, whereby the drum 15 is uncovered. In this condition, one can readily mount or dismount the drum 15 by holding the knob 113 and without the need for removing various process units arranged around the drum 15. While the cartridge 55 is removed, the opening 116 of the collecting tank 27 is directed upward so that the developer 42 is prevented from being scattered around.

The developing unit 18 is movable away from the drum 15 against the action of the spring 120. When the developing unit 18 is so moved, the drum 15 is freely movable within the image forming case and, therefore, it is easy to remove.

Figure 23:
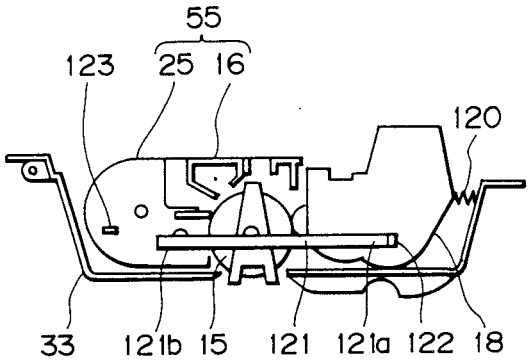
FIG. 23 is a view showing another alternative embodiment of the present invention which includes a device for interlocking the cartridge with a developing unit.
Figure 24:
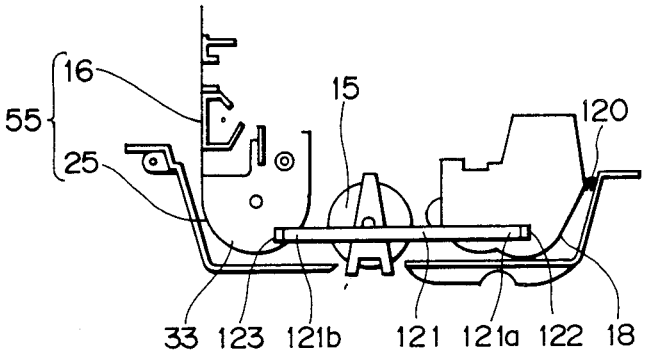
FIG. 24 is a view demonstrating the interlocked movement of the cartridge and developing unit.

Referring to FIGS. 23 and 24, another alternative embodiment of the present invention is shown. In the figures, the same components and structural elements are designated by like reference numerals, and redundant description will be avoided for simplicity. As shown in FIG. 23, in this particular embodiment, a crossbar 121 is disposed in the image forming case 33 and held in a horizontal position. The crossbar 121 extends to the side periphery of the cartridge 55 and that of the developing unit 18. A projection 122 is provided on the side periphery of the developing unit 18, and one end 121*a* of the crossbar 121 is abutted against the lug 122. A projection 123 is provided on the side periphery of the cleaning unit 25 of the cartridge 55 and spaced from the other end 121*b* of the crossbar 121. As shown in FIG. 24, when the cartridge 55 is rotated from the set position to the replaceable position, the projection 123 abuts against the end 121*b* of the crossbar 121 and thereby urges the crossbar 121 to the right in the figure. The end 121*a* of the crossbar 121 in turn urges the projection 122 with the result that the developing unit 18 is retracted away from the drum 15 against the action of the spring 120. In this manner, the crossbar 121 further promotes the ease of replacement of the drum 15.

Figure 25:
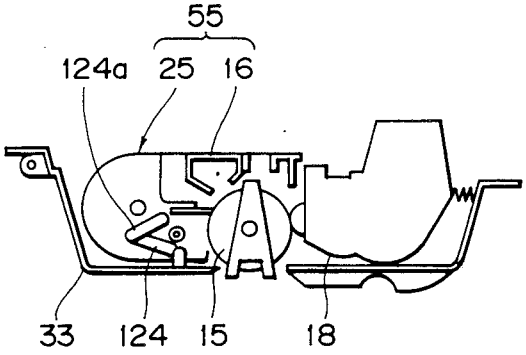
FIG. 25 is a view showing another alternative embodiment of the present invention which includes a device for holding the cartridge in a replaceable position.
Figure 26:
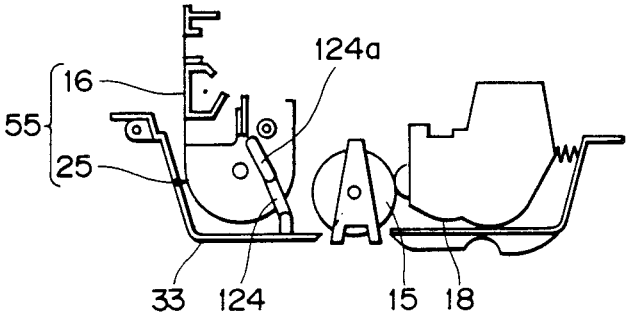
FIG. 26 is a view showing the cartridge held in the replaceable position by the device of FIG. 25.

Referring to FIGS. 25 and 26, another alternative embodiment of the present invention is shown. In the figures, the same components and structural elements are designated by like reference numerals, and redundance description will be avoided for simplicity. As shown in FIG. 25, an articulated foldable stand 124 interconnects the cartridge 55 and image forming case 33. One end 124*a* of the stand 124 is removably affixed to or simply abutted against the cleaning unit 25. In this configuration, when the cartridge 55 is rotated to the replaceable position as shown in FIG. 26, the stand 124 is unfolded to maintain the cartridge in the replaceable position. This allows the drum 15 to be replaced with safetiness.

Figure 27:
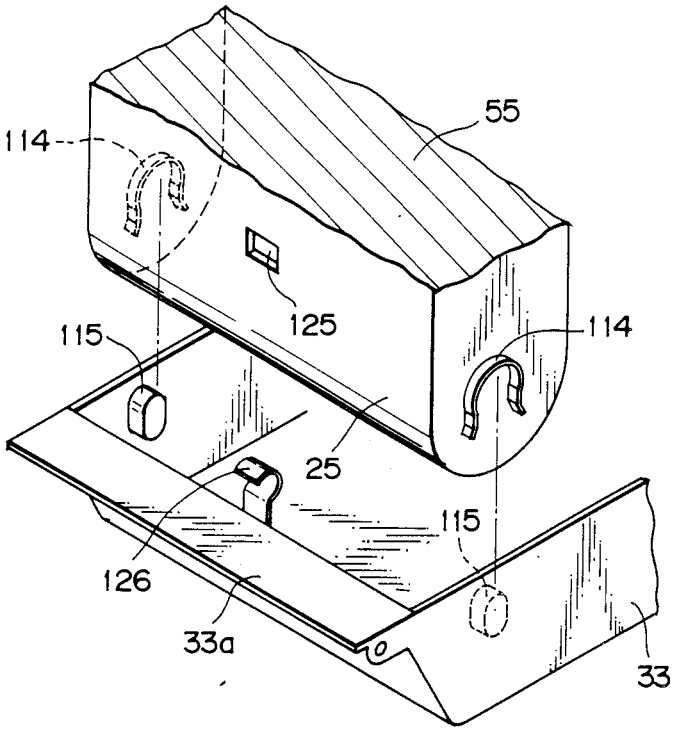
FIG. 27 is an exploded perspective view of a part of the cartridge and a part of the image forming case, showing an alternative configuration of the device for holding the cartridge in the replacealbe position.

FIG. 27 indicates another specific configuration of the means for holding the cartridge 55 in the replaceable position. As shown, the cleaning unit 25 portion of the cartridge 55 is provided with a recess 125, while the image forming case 33 is provided with a leaf spring 126 at one end 33*a* thereof. When the cartridge 55 is rotated to the replaceable position, the recess 125 mates with the tip of the leaf spring 126 to maintain the cartridge 55 in the replaceable position. Such a configuration is also successful in promoting safety replacement of the drum 15.

Figure 28:
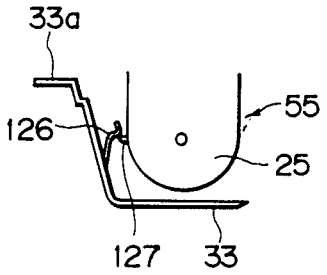
FIG. 28 is a view showing a modified form of the device shown in FIG. 27.

As shown in FIG. 28, the recess 125 of the cartridge 55 may be replaced with a lug 127. Specifically, the lug 127 is provided in the cleaning unit 25 portion of the cartridge 55. As the cartridge 55 is rotated to the replaceable position, the lug 127 engages with the tip of the leaf spring 126 to hold the cartridge 55 in the replaceable position. If desired, the leaf spring 126 may be replaced with an elastic portion which is formed integrally with the image forming case 33 and engageable with the recess 125 or the lug 127.

In summary, in accordance with the present invention, at least a charger and a cleaning unit can be mounted and dismounted integrally with each other. This allows various process units arranged around a photoconductive element to be replaced, repaired or cleaned without the process units being attached and detached one by one. Also, the photoconductive element can be replaced without the need for attaching and detaching the process units one by one. In the event of replacement, repair or cleaning of the process units or replacement of the photoconductive element, a cartridge is rotated to a replaceable position where it it spaced apart from the process units. This frees the photoconductive element from scratches and, at the same time, directs a toner collecting opening of the cleaning unit upward to thereby positively prevent a toner from being scattered around.

Various modifications will become possible for those skilled in the art after receiving the teachings of the present disclosure without departing from the scope thereof.

What is claimed is:

1. A structure of a cartridge for use with an electrophotographic apparatus having a photoconductive element, a charger for charging a surface of said photoconductive element, a writing unit for writing an image on said charged surface of said photoconductive element to form an electrostatic latent image, a developing unit for developing said latent image to form a visible image by a developer which is discharged through an opening formed on a developer container, an image transferring unit for transferring said visible image to a paper sheet, and a cleaning unit for cleaning said surface of said photoconductive element after the image transfer, said cartridge structure comprising:

a main body accommodating at least said cleaning unit and being held in a body of said electrophotographic apparatus in such a manner as to be rotatable between a replaceable position and a set position about a fulcrum provided at a side of said main body of said cartridge where said cleaning unit is positioned; and retaining means provided in said main body of said cartridge for movably mounting said developer container on said cartridge;

said developer container being movable between an open position at which said opening of said developer container is uncovered so that the developer is supplied from said developer container to said developing unit and a closed position at which said opening of said developer container is covered so that said developer is prevented from being discharged from said developer container;

said developer container is moved to said open position when said main body of said cartridge is held in said set position;

said developer container is locked in said closed position when said main body of said cartridge is held in said replaceable position while said developer container is unlocked when said main body of said cartridge is held in said set position.

2. A cartridge structure as claimed in claim 1, wherein said main body of said cartridge is formed with an opening for supplying the developer to the developing unit.

3. A cartridge structure as claimed in claim 2, wherein when said developer container is moved to said open position, said developer is supplied to said developing unit through said opening of said main body of said cartridge and said opening of said developer container.

4. A cartridge structure as claimed in claim 3, further comprising cartridge rotation preventive means for preventing said main body of said cartridge from being rotated to said replaceable position when said developer container is held in said open position.

5. A cartridge structure as claimed in claim 4, wherein said cartridge rotation preventive means comprises cruciform holes formed in a locking lever which is mounted on said main body of said cartridge and locking pawls formed in caps which are mounted on opposite ends of a cylindrical body portion of said developer container, said cartridge being prevented from being rotated to said replaceable position when said locking pawls enter said cruciform holes.

6. A cartridge structure as claimed in claim 1, wherein said main body of said cartridge further accommodates said charger.

7. A cartridge structure as claimed in claim 1, wherein said main body of said cartridge is formed with an opening for writing an image therethrough.

* * * * *